US009895569B2

(12) United States Patent
Yao

(10) Patent No.: US 9,895,569 B2
(45) Date of Patent: Feb. 20, 2018

(54) EXERCISE GARMENT WITH ERGONOMIC AND MODIFIABLE RESISTANCE BANDS

(71) Applicant: NEW YORK UNIVERSITY, New York, NY (US)

(72) Inventor: Franklin Yao, Kew Gardens, NY (US)

(73) Assignee: NEW YORK UNIVERSITY, New York, NY (US)

( * ) Notice: Subject to any disclaimer, the term of this patent is extended or adjusted under 35 U.S.C. 154(b) by 0 days.

(21) Appl. No.: 14/694,900

(22) Filed: Apr. 23, 2015

(65) Prior Publication Data

US 2015/0306441 A1 Oct. 29, 2015

Related U.S. Application Data

(60) Provisional application No. 61/983,746, filed on Apr. 24, 2014.

(51) Int. Cl.
*A63B 21/00* (2006.01)
*A63B 21/002* (2006.01)
(Continued)

(52) U.S. Cl.
CPC ..... *A63B 21/0407* (2013.01); *A63B 21/002* (2013.01); *A63B 21/0004* (2013.01);
(Continued)

(58) Field of Classification Search
CPC ..... A63B 21/0004; A63B 21/00178; A63B 21/00181; A63B 21/00185; A63B 21/002; A63B 21/02; A63B 21/04; A63B 21/0407; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/4005; A63B 21/4007; A63B 21/4009;
(Continued)

(56) References Cited

U.S. PATENT DOCUMENTS 807,908 A * 12/1905 Bradstreet ..... A63B 22/001 482/51
5,046,194 A * 9/1991 Alaniz ..... A41D 13/0015 2/69
(Continued)

FOREIGN PATENT DOCUMENTS

CN 202151117 U 2/2012
GB 2 501 396 10/2013
GB GB 2501396 A * 10/2013 ..... A41D 13/0015

OTHER PUBLICATIONS

International Search Report and Written Opinion for Appl. No. PCT/US2015/027370, dated Jul. 30, 2015, 10 pages.
(Continued)

*Primary Examiner* — Loan H Thanh
*Assistant Examiner* — Gary D Urbiel Goldner
(74) *Attorney, Agent, or Firm* — Foley & Lardner LLP

(57) ABSTRACT

A garment that generates resistance against body movement that can be used during exercise, during everyday activities, or during rehabilitation therapy. The garment includes bands providing resistance against the movement of an associated limb. The garment includes a structure to secure the garment to a user during activity.

9 Claims, 8 Drawing Sheets

(51) Int. Cl.

| | |
|---|---|
| ***A63B 21/04*** | (2006.01) |
| ***A63B 21/055*** | (2006.01) |
| ***A63B 21/065*** | (2006.01) |
| ***A63B 69/00*** | (2006.01) |
| ***A63B 71/00*** | (2006.01) |
| ***A63B 23/035*** | (2006.01) |

(52) U.S. Cl.
CPC ..... *A63B 21/0414* (2013.01); *A63B 21/0555* (2013.01); *A63B 21/065* (2013.01); *A63B 21/4005* (2015.10); *A63B 21/4007* (2015.10); *A63B 21/4009* (2015.10); *A63B 21/4011* (2015.10); *A63B 21/4017* (2015.10); *A63B 21/4019* (2015.10); *A63B 21/4021* (2015.10); *A63B 21/4025* (2015.10); *A63B 23/03583* (2013.01); *A63B 69/0028* (2013.01); *A63B 2069/0031* (2013.01); *A63B 2069/0033* (2013.01); *A63B 2071/0072* (2013.01)

(58) Field of Classification Search
CPC ..... A63B 21/4011; A63B 21/4017; A63B 21/4019; A63B 21/4023; A63B 21/4025; A63B 21/4027; A63B 21/4039; A63B 21/4043; A63B 2023/003; A63B 2023/006; A63B 23/04; A63B 23/0405; A63B 23/0482; A63B 23/0488; A63B 23/0494; A63B 69/0028; A63B 69/0057; A63B 69/0059; A63B 2069/0031; A63B 2069/0033; A63B 2069/0062; A63B 71/0054; A63B 71/1225; A63B 2071/0072; A63B 2071/1233; A63B 2071/1241; A63B 2071/125; A63B 2209/02; A63B 2209/023; A63B 2209/026
See application file for complete search history.

(56) References Cited

U.S. PATENT DOCUMENTS

| | | | | | |
|---|---|---|---|---|---|
| 5,109,546 | A | | 5/1992 | Dicker | |
| 5,176,600 | A | | 1/1993 | Wilkinson | |
| 5,465,428 | A | * | 11/1995 | Earl | A63B 21/0552 2/227 |
| 5,606,745 | A | * | 3/1997 | Gray | A41D 13/0015 2/227 |
| 5,700,231 | A | | 12/1997 | Wilkinson | |
| 5,745,917 | A | | 5/1998 | Dicker et al. | |
| 5,778,452 | A | * | 7/1998 | Dicker | A41D 13/0015 2/227 |
| 5,792,034 | A | | 8/1998 | Kozlovsky | |
| 5,819,322 | A | | 10/1998 | Dicker et al. | |
| 5,829,058 | A | | 11/1998 | Dicker et al. | |
| 5,842,959 | A | | 12/1998 | Wilkinson | |
| 5,857,947 | A | | 1/1999 | Dicker et al. | |
| 5,867,827 | A | * | 2/1999 | Wilkinson | A41D 13/0015 2/115 |
| 5,875,491 | A | | 3/1999 | Wilkinson | |
| 5,978,966 | A | * | 11/1999 | Dicker | A41D 13/0015 2/115 |
| 6,053,852 | A | * | 4/2000 | Wilkinson | A41D 13/0015 2/69 |
| 6,099,446 | A | * | 8/2000 | Johnson | A63B 21/0004 482/124 |
| 6,179,760 | B1 | | 1/2001 | Rumbaugh | |
| 6,213,922 | B1 | | 4/2001 | Afanasenko et al. | |
| 6,231,488 | B1 | * | 5/2001 | Dicker | A41D 13/0015 2/69 |
| 6,258,014 | B1 | * | 7/2001 | Karecki | A41D 13/0015 2/23 |
| 7,744,511 | B2 | | 6/2010 | Grigoriev et al. | |
| 7,908,670 | B2 | | 3/2011 | Semba et al. | |
| 8,533,864 | B1 | * | 9/2013 | Kostrzewski | A41D 13/0015 2/69 |
| 8,544,114 | B2 | | 10/2013 | Williams et al. | |
| 8,832,863 | B2 | * | 9/2014 | Yang | A63B 21/0552 2/69 |
| 9,144,252 | B1 | * | 9/2015 | Kostrzewski | A41D 1/08 |
| 9,326,554 | B2 | * | 5/2016 | Lou | A41D 1/06 |
| 2003/0092545 | A1 | * | 5/2003 | Koscielny | A61H 1/02 482/124 |
| 2004/0255358 | A1 | * | 12/2004 | Ota | A41D 13/0015 2/69 |
| 2005/0193461 | A1 | * | 9/2005 | Caillibotte | A41D 13/0015 2/69 |
| 2005/0255975 | A1 | | 11/2005 | Horn et al. | |
| 2007/0004570 | A1 | * | 1/2007 | Afanasenko | A61F 5/01 482/124 |
| 2007/0004571 | A1 | * | 1/2007 | Gonzalez | A63B 21/4025 482/124 |
| 2007/0135279 | A1 | * | 6/2007 | Purdy | A63B 21/0004 482/124 |
| 2007/0271668 | A1 | * | 11/2007 | Pape | A41D 13/0015 2/69 |
| 2010/0144490 | A1 | * | 6/2010 | Purdy | A63B 21/0004 482/1 |
| 2011/0314590 | A1 | | 12/2011 | Perron et al. | |
| 2012/0094811 | A1 | * | 4/2012 | Karecki | A63B 21/4025 482/121 |
| 2013/0067628 | A1 | | 3/2013 | Harb | |
| 2013/0150218 | A1 | | 6/2013 | Mial | |
| 2013/0288863 | A1 | * | 10/2013 | Yamamoto | A61H 1/024 482/124 |
| 2014/0096301 | A1 | * | 4/2014 | Waller | A41D 7/00 2/67 |
| 2014/0179497 | A1 | * | 6/2014 | von Hoffmann | A63B 23/0494 482/124 |
| 2014/0200121 | A1 | * | 7/2014 | von Hoffmann | A63B 21/02 482/124 |
| 2015/0196789 | A1 | * | 7/2015 | Whitt | A63B 21/00185 482/124 |

OTHER PUBLICATIONS

Preliminary Report on Patentability for International Application No. PCT/US2015/027370, dated Nov. 3, 2016, 9 pages.

* cited by examiner

EXERCISE GARMENT WITH ERGONOMIC AND MODIFIABLE RESISTANCE BANDS

CROSS-REFERENCE TO RELATED APPLICATIONS

This application claims the benefit of U.S. Provisional Application No. 61/983,746 filed on Apr. 24, 2014, which is hereby incorporated by reference in its entirety.

FIELD OF THE INVENTION

The present invention generally relates exercise garments.

BACKGROUND OF THE INVENTION

Physical inactivity has become a pervasive problem affecting millions of people, especially in the United States. According to a 2012 CDC report, only one in five US adults meet physical activity guidelines set by the US Department of Health and Human Services. A study by researchers at Cambridge University that tracked 334,000 people over 12 years found that physical inactivity conferred twice the risk of mortality as obesity.

On the positive side, the Cambridge study found that even a relatively small lifestyle change, such as taking a brisk 20-minute walk per day, moves one from "inactive" to "moderately active" and reduces a one's risk of death by 16-30%. Despite this, most people face various limitations that make it difficult to integrate even this level of activity into their lifestyles. For example, less than 20% of jobs involve physical exertion, with people spending on average 4 hours sitting at work per day. Furthermore, people now participate less in physical activities and more in sedentary behavior at home and during leisure time as well. Additionally, a general lack of time and motivation are among the most common excuses not to exercise.

The fitness industry has traditionally emphasized gym and machine-based exercise regimens to improve workout efficiency and maximize results. However, the need to set aside time to travel and work out at a gym can be difficult and discouraging for many people, as evidenced by the fact that three quarters of gym memberships go unused after the yearly January surge. Recent innovations in the fitness sector have moved towards home fitness, supplemented with personalized tracking and wearable technology. However, these still don't address the primary concern for a large population of people who simply don't have the time or motivation to adopt a sufficiently active lifestyle in the first place. There is a clear need for a convenient and effective method to help people lose weight and improve physical fitness that can be seamlessly incorporated into their daily lives.

SUMMARY OF THE INVENTION

One implementation of the invention relates to an apparatus for providing resistance. A resistance segment is affixed to a base material. The resistance segment comprises a first resistance band and a second resistance band. The first resistance band and the second resistance band are opposed.

Another implementation relates to an exercise system. A base material is included. An extension resistance band is engaged with the base material. A flexion resistance band is engaged with the base material. A first biaxial retention mechanism and a second a retention mechanism are integrated with the base material and positioned to secure the garment against the force exerted by either the extension resistance band or the flexion resistance band.

Additional features, advantages, implementations, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The foregoing and other objects, aspects, features, and advantages of the disclosure will become more apparent and better understood by referring to the following description taken in conjunction with the accompanying drawings, in which:

FIG. 1A is a ventral view and FIG. 1B is a dorsal view.

DETAILED DESCRIPTION

Figure 1B:
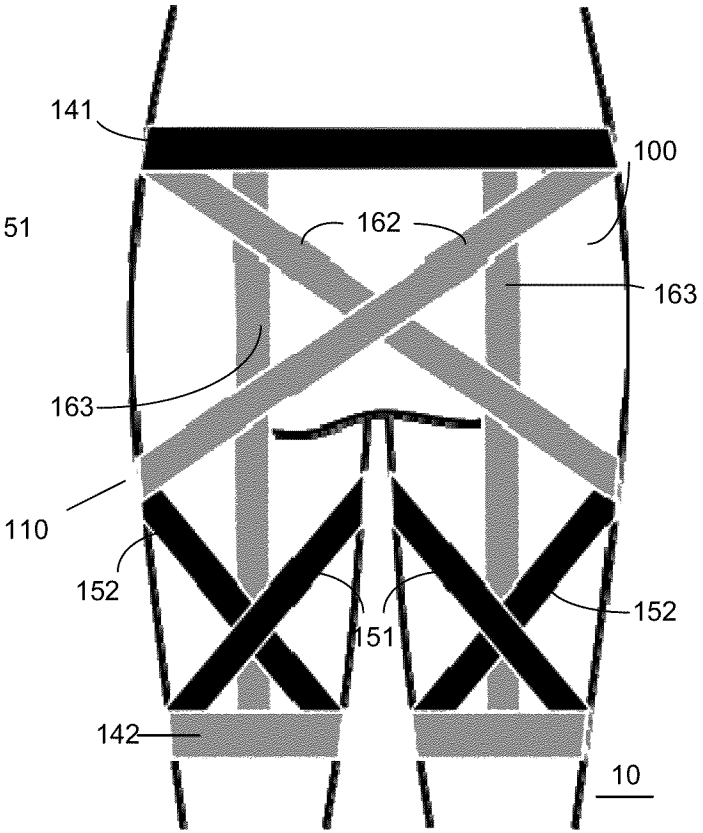
FIGS. 1A-B illustrate an exercise garment for the upper legs where bands are placed to counteract specific muscle groups and secured in place by a fixation system having a biaxial arrangement, with two sets of bands offering opposing both flexion and extension of each limb.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Current body toning clothing generally comprises garments that use compression to make the muscles feel tighter. However, they don't actually restrict the movement of the limb and they have been shown to have minimal effectiveness in terms of toning muscle and burning calories. Other technologies claim to burn calories through retaining body heat to make the person sweat, but also demonstrate relatively low effectiveness.

There have not been successful garments that resist body movement because none have found an efficient way of fixing resistance bands to the body without having them slide up and down, in which the bands become ineffective. The closest technologies have the bands wrapped around the end of the limb, such as the hand or the heel, which limits the product to being a full-body garment. Furthermore, this limited fixation systems forces the same band to extend across the entire limb over many different joints and muscle groups. As a result, the resistance generated is applied haphazardly and can interfere with normal body kinetics such as gait, which could potentially be dangerous.

Implementations of the present invention offers an improvement to exercise and rehabilitation equipment and garments 10. The garments 10 include a fixation system 130 that can hold resistance segments to almost any part of the body. This allows for resistance segments, such as bands 110 or panels 115, that span only one joint or muscle group to achieve more biomimetic positioning. This also allows for opposing sets of bands 115 to be placed around a resting position that can be modulated according to the application.

As shown in FIG. 1, implementations of the present invention are related to a novel, resistance-generating garment 10 that incorporates to a base material 100 built-in resistance segments, such as resistance bands 110, that are anatomically positioned to oppose limb movement and encourage muscle activation. The resistance bands 110 and the garment 10 as a whole are retained in place against the forces of the bands 110 by fixation system 130. As a result, targeted muscles recruit more motor units and expend more energy to achieve the same motion. In one implementation, the positioning of the bands 110 is coordinated with the underlying anatomy and the bands 110 are fixed relative to the body.

The base material 100 may be selected for suitable applications. For example, the base material 100 may be natural or synthetic materials. The base material may be a blend of such. In one implementation, the base material 100 may be a moisture wicking material. The base material 100 may be a stretchable materials such as for providing a compression fit.

Figure 1A:
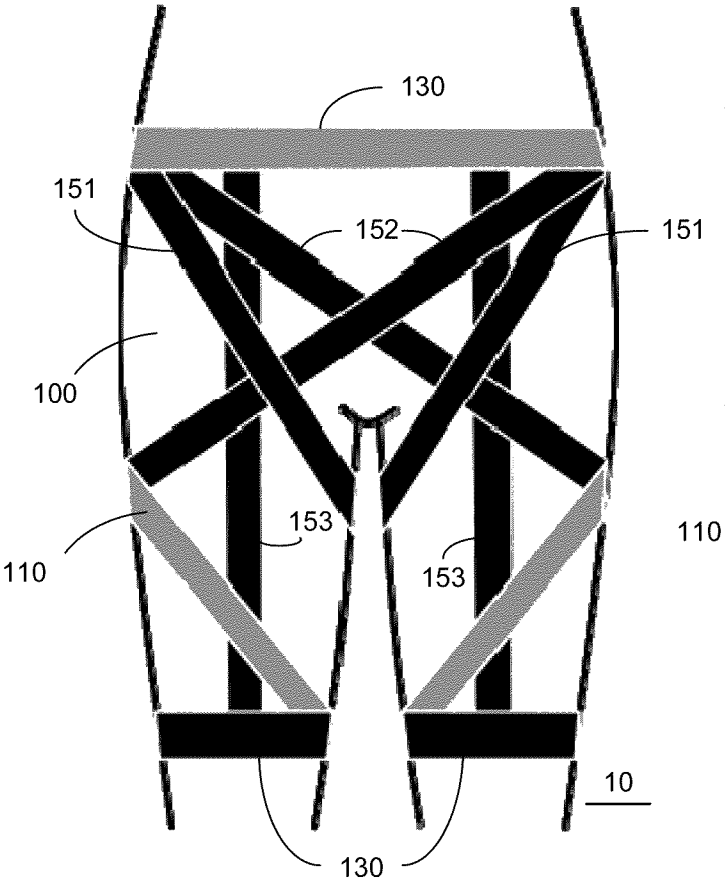

The bands are placed to counteract specific muscle groups. For example, many limb movements comprise a set of opposing muscles for movement. The bands 110 may correspond to sets of bands offering opposing both flexion and extension of each limb. For example, as shown in FIGS. 1A-B, the bands 110 comprise flexion bands 162, 163 (lightly shaded bands) and extension bands 151, 152, 153 (dark shaded bands). In one embodiment, this is accomplished through the selection of resistance properties such that neither the flexion band or the extension band have tension when the limb is in a resting position (e.g. legs parallel to the body in standing position). Alternative embodiments may have a neutral point, that is the position of the body part where neither the flexion bands or the extension bands are under tension and expert resistance, that is not resting position, such as with arm rotated.

Figure 2B:
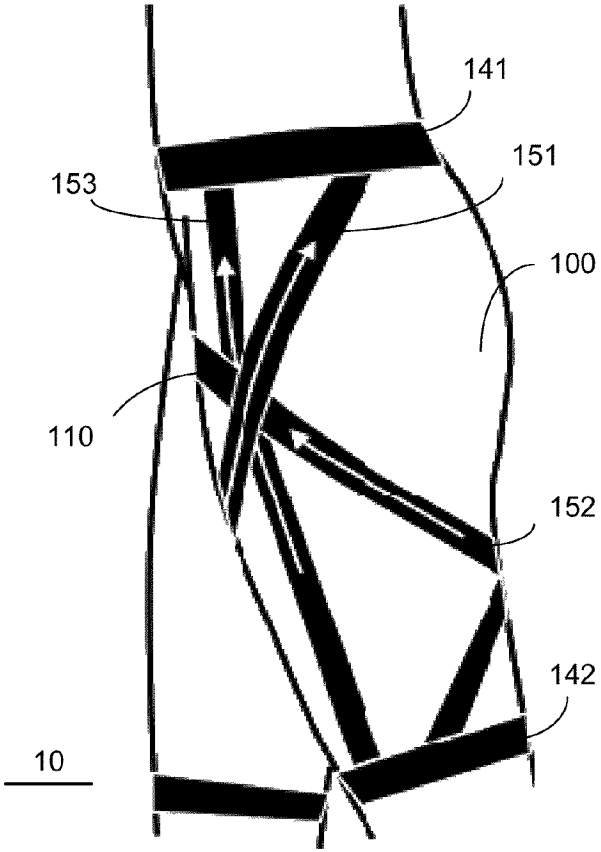
FIGS. 2A-B demonstrate how two sets of bands create resistance against flexion (FIG. 2A) and extension (FIG. 2B) of the hip.
Figure 2A:
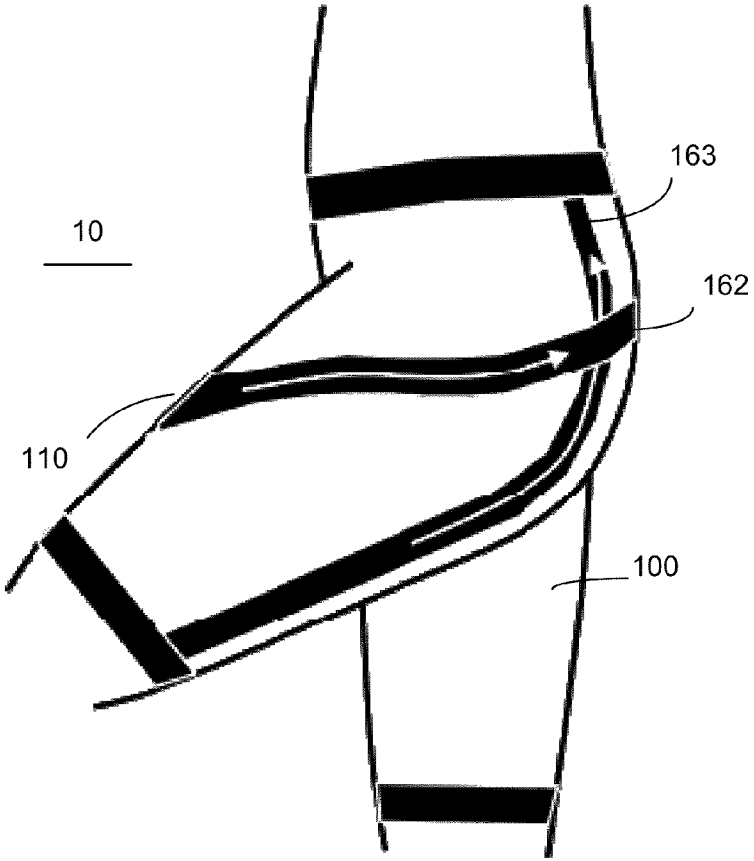
Figure 3B:
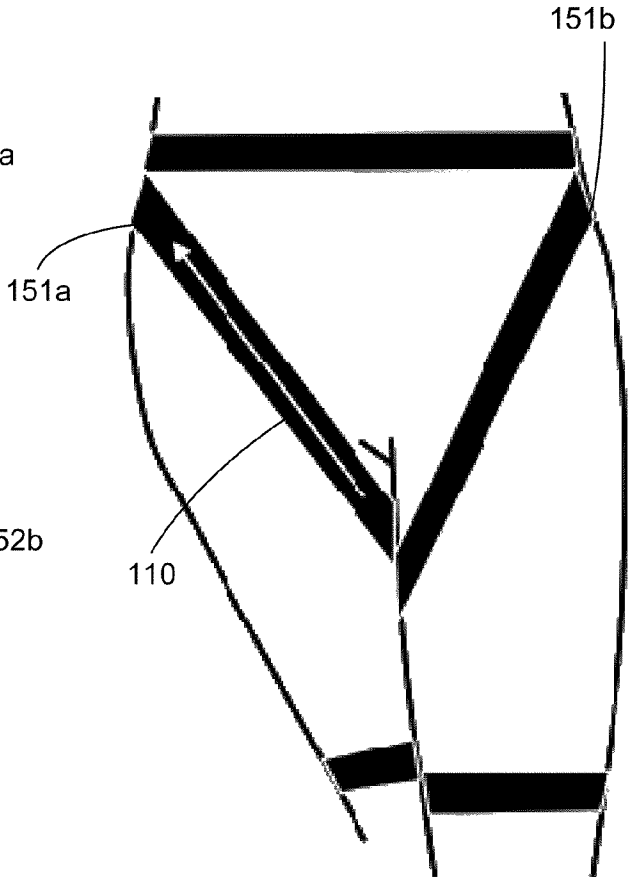
FIGS. 3A-B demonstrates how two sets of bands create resistance against abduction and adduction of the hip.
Figure 3A:
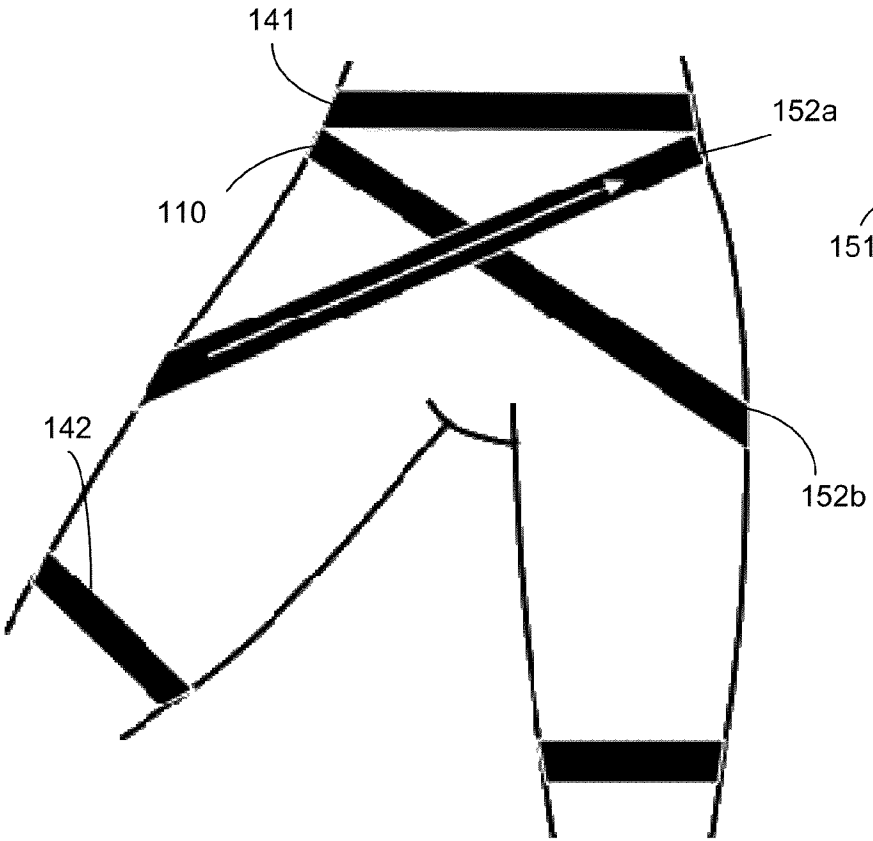

Flexion of the limb causes the flexion band to stretch, creating tension that exerts force against the movement of the limb and towards the neutral state, thus providing resistance to the flexion of the limb. For example, in the garment 10 of FIG. 2A-2B, the band 163, which extends from the back over the gluteus maximus and hamstrings, resists flexion of the upper leg. Meanwhile, the corresponding extension band crumples without creating any tension in a flexion action. For example, with continued reference to FIG. 2A-2B, the band 153 extending down the front over the iliopsoas and quadriceps exerts not force and is not under tension during such movement. Therefore, flexion creates a net force pulling back on the limb despite the presence of two opposing sets of bands. For many joints or muscle groups, a plurality of bands can be utilized to provide resistance to all possible movement. For example, FIGS. 3A-3B also illustrate band 110 that provide for abduction and adduction resistance. The same principle applies for flexion, extension, adduction, and abduction of almost any body part, including shoulders, arms, fingers, abdomen, hip, legs, and knees. Further, the bands 110 may provide torsional resistance for rotational motions, such as for rotation of the wrist, shoulder, angles, or hip joints.

In one implementation, these bands 110 comprise thin, individual resistant fibers made of a resistant material and woven directly into the fabric. These resistant fibers may of a different material than the base material 100. The resistance fibers may be individually attached to the garment, bound into a flat band, or bound into a bundle to form the band. The band 110 is attached, in one implementation, at an anchor 130 to the garment 10.

In another implementation, the bands 110 may comprise sections of the garment that are integrated, such as by sewing, gluing, sonic welding, or the like, with the base material 100.

Figures 5A, 5B, 5C:
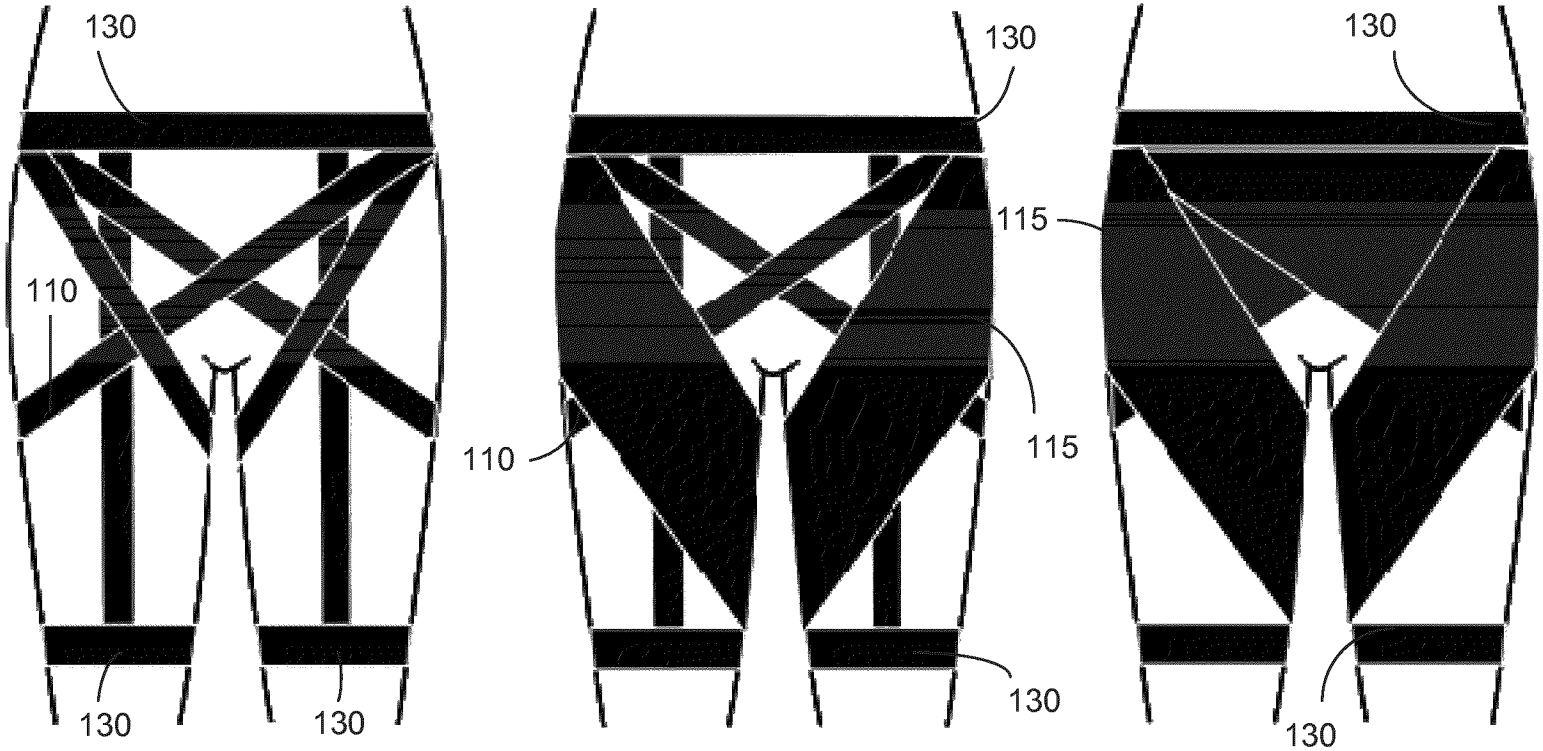
FIGS. 5A-C illustrates an implementation where the bands can be replaced with differently sized bands (FIG. 5A), bands and panels (FIG. 5B) or panels (FIG. 5C) to vary the distribution of forces along the surface of the body.
Figure 6:
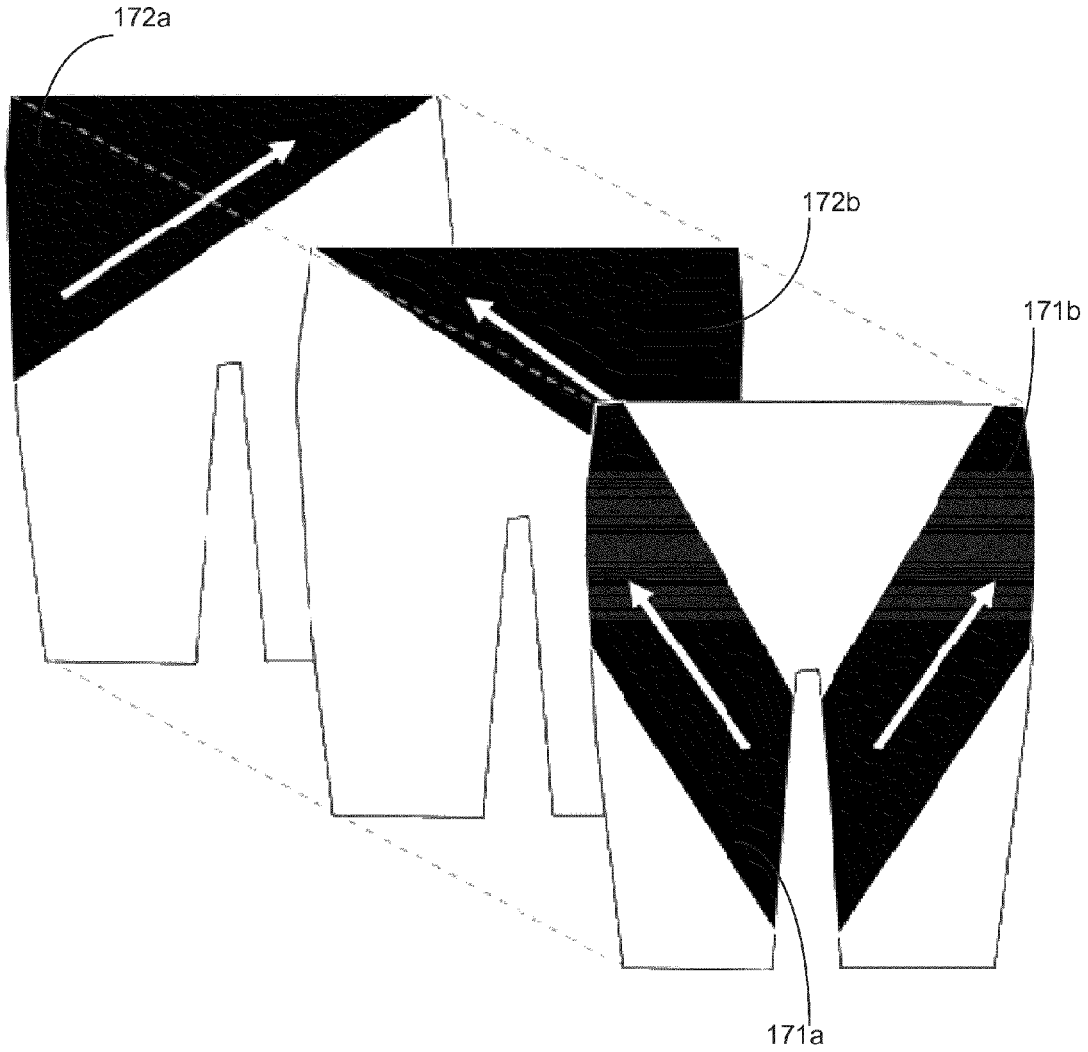
FIG. 6 illustrates an implementation where the bands are replaced by elastic mesh panels arranged in free-floating layers within a single garment that are allowed to slide past each other as the body moves.
Figures 7A, 7B, 7C:
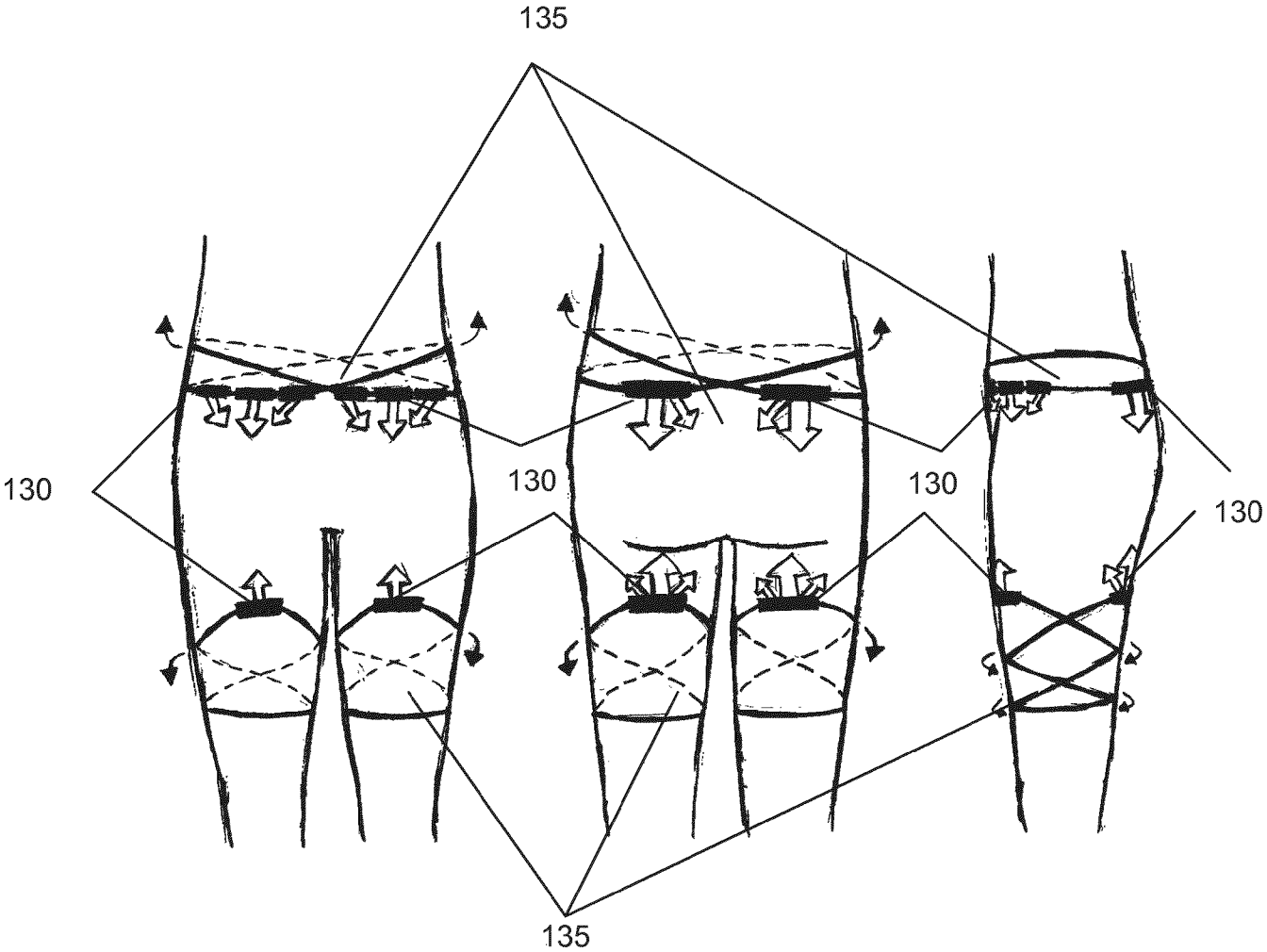
FIG. 7A-C show implementation with a fixation system and helical weave and a failsafe mechanism, such as a clip that can be activated to immediately loosen the bands in case of emergency.

In another implementation, best shown in FIG. 5C and FIG. 6, the resistance segments consist of panels 115. The panels 115 may be solid material, oven material, or material with pores arranged in a mesh-like fashion to allow for breathability. These panels 115 can be stitched directly into the base material 100, sandwiched between layers of base materials 100, or attached to portions of the base material 100 such that the panels 115 form an integral part of the garment, such as a front panel of pants. In one embodiment, the panels 115 provide resistance in multiple axes.

FIG. 5A illustrates an embodiment using bands 110. FIG. 5B illustrates a mixed use embodiment using bands 110 in combination with panels 115. The panels 115 may provide for more resistance than bands 110 or may provide resistance for larger arc of movement.

Figures 4A, 4B:
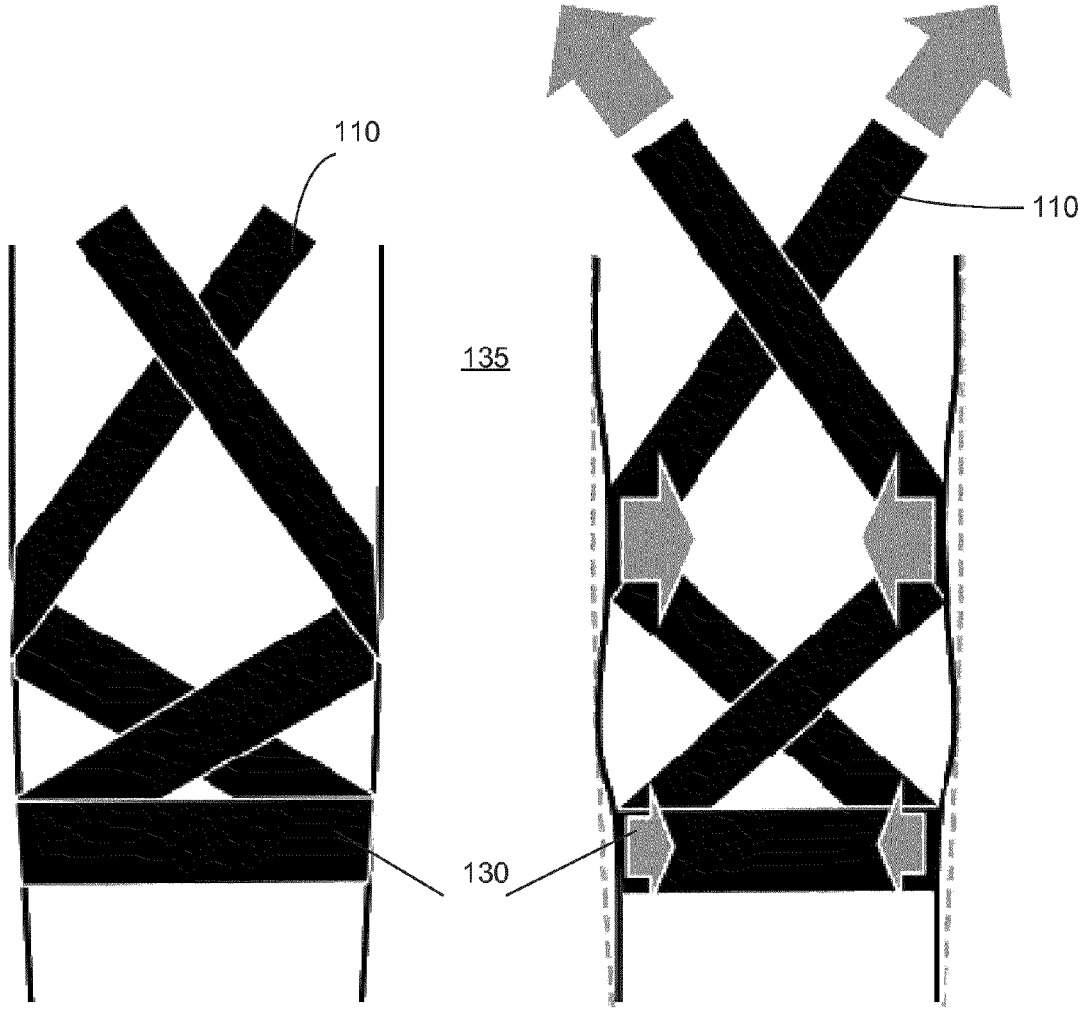
FIGS. 4A-B illustrates how the biaxial band position allows them to tighten around the body as they become stretched, which functions to provides compression and keep the bands in place, with FIG. 4A showing relaxed position and FIG. 4B showing a compressed position.

An retention mechanism 130 is provided to prevent the resistance segments from moving the garment 10 appreciably and to fix the resistance segments relative to the associated body part. The retention mechanism may be a continuation of the resistance segments, such as the bands 110, such that the resistant segment wraps around a limb. In such implementations, such as seen in FIG. 1A, the bands 110 are continuous and form both of the opposing segments and the retention mechanism 130. In one implementation, a series of biaxial retention mechanisms 130, best shown in FIGS. 4A-B and FIGS. 7A-C, keeps the resistance segments, in the Figures bands 110 fixed in position relative to the limbs. The ends of the bands 110 are attached to the fixation system 130, which is secured to or integral with series of non-stretchable, helically wound biaxial weaves 135, which are wrapped around the body. Similar to a Chinese finger trap, the weaves tighten around the limb when pulled longitudinally by the bands. This creates traction and prevents the bands from riding up the limb during periods of tension, while also minimizing discomfort from compression while the wearer is at rest. In one implementation, the weaves are made of individual, non-stretch fibers woven directly into the fabric. In another implementation, the bands 110 made of a non-stretch material that are wrapped around the body and then stitched in place. In yet another implementation, the entire sleeve or portion of the garment is created from a non-stretch fabric woven using a biaxial pattern. In one embodiment of FIG. 4A-B, the bands 110 maybe a continuous band 110 forming the fixation system by wrapping about a body part as part of the garment 10.

Figures 8A, 8B:
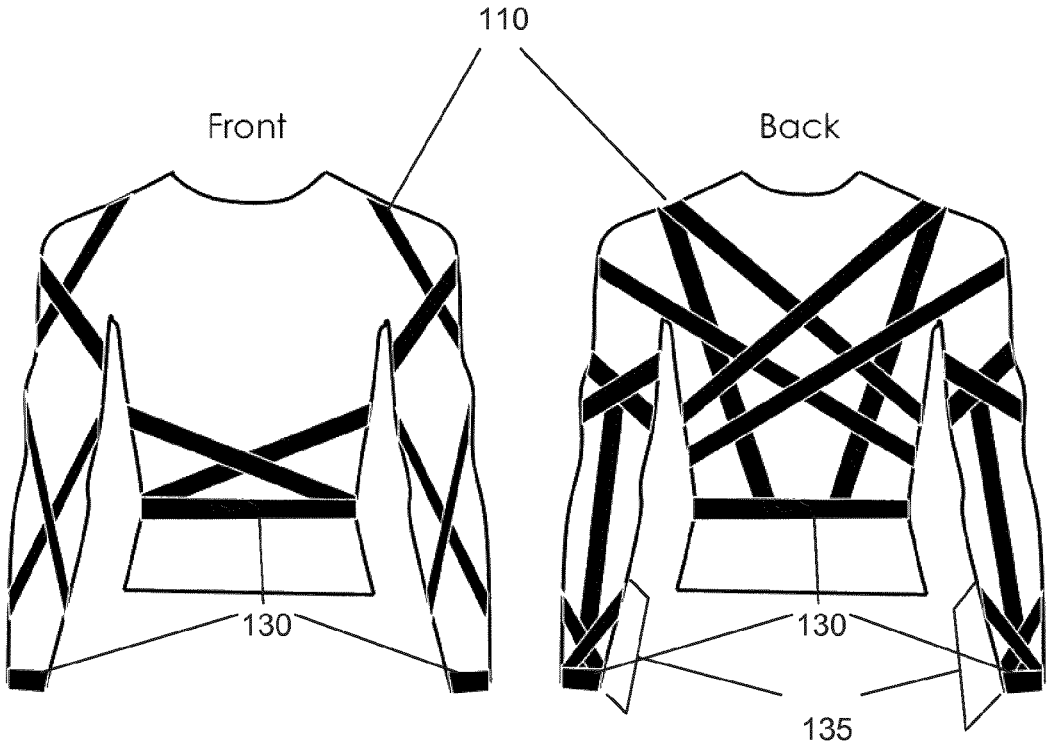
FIGS. 8A-B illustrate an implementation of resistance segments using bands for a upper body, long sleeve garment, with FIG. 8A illustrating the ventral view and FIG. 8B the dorsal view.

While the implementations are described for example purposes primarily in terms of upper leg garments, it should be appreciated the principles of the present invention may be applied to garments for other body parts or the whole body. For example, FIGS. 8A-B illustrate an implementation of resistance segments using bands 110 for a upper body, long sleeve garment with the fixation system 130 at the waist and wrist cuffs and a helical weave 135 structure at the wrists and waist.

In one implementation biaxial weave system also comprises a failsafe mechanism, such as a clip (show in FIGS. 7A-C), that can be activated to immediately loosen the bands in case of emergency.

The resistance material to be used for the resistance segments can be adjusted to vary the balance between opposing muscle groups and to determine where the limb's resting position is, at which it experiences no tension. This can be used to guide the body into a more ideal posture. Different materials, ranging from relatively cheap vulcanized silicone to more sophisticated electroactive polymers, can be used to suit different applications.

In one implementation, the resistance segments are made from a simple linearly-elastic rubber is used to achieve a relatively cheap construct that is more effective for vigorous activities and suited for high-intensity training.

In one implementation, the resistance segments are more resistant, i.e. have an elastic modulus substantially higher, than the base material. For example, in one implementation, the bands 110 are 20-30 times and the panels 115 are about 8 times as resistant as the base material of the garment 10.

In another implementation, the resistance segments are constructed from a particular elastomer that displays a non-linear stress-strain curve with a relatively high elastic modulus at small strains that decreases with greater strains. Such a material would allow for significant resistance during actions that require minimal limb movement, such as walking, while not over-restricting more vigorous actions, such as running.

In another implementation, a non-linear, viscoelastic polymer is used to generate isokinetic-like resistance, in which the resistance varies according to the speed of the motion. This would provide additional benefits for casual, low-intensity activities as well as for rehabilitation purposes.

In a third implementation, the resistance segments are made from an electroactive polymer that communicates with an embedded electronic controller to measure muscle movements and modulate resistance in response to manual or preset controls. In one such implementation, the tension in the band can be measured with an attached pressure sensor. The changes in tension in different sets of bands could then be used to determine the angle and direction of limb movements, providing accurate 3-dimensional tracking data. The EAP can be used to modulate resistance as well. Application of voltage causes the polymer band to expand, thereby decreasing tension. This property can be used to modify the overall resistance of the garment, change the resting position of different limbs, or even actively move the limbs itself.

The attachment of the resistance segments to the biaxial weaves 135 can also vary with the application. In one implementation, such as shown in FIG. 1A, they can be permanently fused, such as in the context of seamless clothing that appears similar to normal exercise wear. In another implementation, such as FIGS. 7A-C, they can be detached and reattached, allowing the user to easily switch out resistance segments in order to customize the amount of tension and the ratio between opposing bands. In this case, the resistance segment are not sown into the fabric and instead are, for example for bands 110 layered within a pocket or channel so that they can be easily inserted and removed or, for example for panels 115 layered as one panel 115 on top of another panel 115. For example, in one implementation the resistance segment is fused to a small clip that would allow for the resistance segment to be detached or reattached, as well as tightened and loosened.

In another implementation, the resistance segments are positioned on the garments in a manner to mimic the underlying musculature structure. For example, the bands 110 may be positioned in line with the underlying tendons.

In another implementation, the garment 10 is adapted to be used for rehabilitation.

In another implementation, the garment 10 is adapted for use with elderly or physically disabled. In such implementation, the garment 10 provides a buffer against movements, such as sudden movements, to aid the wearer in maintaining balance and or posture.

The technology described herein can be used in fitness tights to increase the metabolic equivalents of common activities such as walking, jogging, and cycling, with the goal of helping people get fit in a convenient and nonintrusive fashion. The resistance system is incorporated into a thin and discreet apparel design that can be worn underneath everyday clothes, allowing people to wear them during work or school without standing out. The fabric is also comfortable and fashionable, encouraging people to wear them like normal exercise tights in order to supplement workouts and achieve better results in less time.

In a rehabilitation setting, this technology can comprise medical devices that use a very low-intensity resistance to maintain muscle tone and counteract the effects of sarcopenia, or age-related muscle atrophy, leading to better balance and overall quality of life. It can also be used with high resistance to provide a safe means of physical therapy for people recovering from musculoskeletal injuries.

In one embodiment, the resistance segments are of varying widths to alter the distribution of forces along the surface of the body (see FIGS. 5A-C and FIG. 6). Narrower bands 110 allow for more precise placement and greater resistance, while wider panels 115 reduce discomfort and prevent the garment from being so tight that it cuts into softer areas of the body, such as the inner thighs (example in FIG. 4B).

In one embodiment, the resistance segment comprise panels 115 that one or more layers of elastic power mesh, comprising one or more elastic materials constructed in a mesh structure to allow greater fit and breathability (see FIG. 5C). Panels 115 with two layers of power mesh exhibit better resistance and stability than single layer panels. Also, whereas single-layered panels 115 may become semi-transparent when stretched, double-layered panels are opaque, a relevant consideration where the panels 115 form an integral part of the garment 10 and are not backed by the base material 100. In addition, slight movements between the two mesh layers of this embodiment of the panel 115, in certain light conditions, create a unique optical rippling effect.

The multilayered panel 115 stretching in different directions are arranged in free-floating layers can slide past each other in order to achieve the biaxial tightening behavior (see FIGS. 5A-C). Therefore the panels 115 form two or more garment layers that can rotate around the body independently of each other and are seamed together at one or more locations, such as the waist or the inseam. Increasing the number of free-floating layers increases the tightness of the biaxial compression. A fastening mechanism, such as a zipper or drawstring, may be attached to certain panels to adjust both tightness and resistance.

In one embodiment, the garment is constructed with channels in which the bands are placed. The channeling allows bands to move independently of the base fabric, which reduces wrinkling and chafing.

In another embodiment, the garment is constructed with channels with modifiable bands that can be removed and replaced. The bands can be attached to fastening mechanisms, such as patches of Velcro or ring hooks, which are positioned at the both ends of the channels.

The foregoing description of illustrative implementations has been presented for purposes of illustration and of description. It is not intended to be exhaustive or limiting with respect to the precise form disclosed, and modifications and variations are possible in light of the above teachings or may be acquired from practice of the disclosed implementations. It is intended that the scope of the invention be defined by the claims appended hereto and their equivalents.

What is claimed is:

1. An exercise garment for providing resistance comprising:

a base material; and a resistance segment affixed to the base material by an affixation system; the resistance segment comprising a first panel, a second panel, a first resistance band and a second resistance band;

wherein the first panel and the second panel are seamed together at an inseam of a leg of the exercise garment and are slidable relative to each other; wherein the first resistance band and the second resistance band are configured to act in opposition to each other; wherein the first panel is layered at least partially over the second panel; and wherein the first panel and second panel provide resistance along multiple axes.

2. The exercise garment of claim 1, further wherein the affixation system is a biaxial retention mechanism for securing the resistance segment to the base material.

3. The exercise garment of claim 1, further comprising a third resistance band.

4. The exercise garment of claim 1, where the first resistance band and the second resistance band comprise a plurality of resistance fibers.

5. The exercise garment of claim 1, wherein the first resistance band and the second resistance band are removably affixed to the base material.

6. The exercise garment of claim 1, wherein the first resistance band and the second resistance band have a modulus of elasticity substantially greater than that of the base material.

7. The exercise garment of claim 1, wherein the base material further comprises a first channel configured to receive the first resistance band and a second channel configured to receive the second resistance band.

8. The exercise garment of claim 1, wherein the first panel and the second panel have a resistance 8 times a resistance of the base material and further wherein the first and second resistance bands have a resistance of 20-30 times the resistance of the base material.

9. The exercise garment of claim 1, wherein the first panel and the second panel are sandwiched between layers of the base material.

* * * * *